United States Patent [19]

Bruce

[11] Patent Number: 4,802,434

[45] Date of Patent: Feb. 7, 1989

[54] ANCHOR

[75] Inventor: Peter Bruce, Onchan, United Kingdom

[73] Assignee: BruPat Limited, Onchan, United Kingdom

[21] Appl. No.: 46,857

[22] PCT Filed: Mar. 9, 1986

[86] PCT No.: PCT/GB86/00522

§ 371 Date: May 5, 1987

§ 102(e) Date: May 5, 1987

[87] PCT Pub. No.: WO87/01347

PCT Pub. Date: Mar. 12, 1987

[30] Foreign Application Priority Data

Sep. 5, 1985 [GB] United Kingdom ..... 8522062
May 3, 1986 [GB] United Kingdom ..... 8610914

[51] Int. Cl.[4] ..... B63B 21/34
[52] U.S. Cl. ..... 114/294; 114/301
[58] Field of Search ..... 114/294, 295, 301, 303, 114/308

[56] References Cited

U.S. PATENT DOCUMENTS 4,173,938 11/1979 Covin ..... 114/301
4,577,581 3/1986 Puech ..... 114/294
4,706,595 11/1987 van den Haak ..... 114/294

FOREIGN PATENT DOCUMENTS 2314094 1/1977 France ..... 114/301
43282 4/1977 Japan ..... 114/301
180391 10/1983 Japan ..... 114/301
2035242 6/1980 United Kingdom ..... 114/301
2083428 3/1982 United Kingdom ..... 114/301

*Primary Examiner*—Sherman D. Basinger
*Assistant Examiner*—Stephen P. Avila
*Attorney, Agent, or Firm*—Mason, Fencik & Lawrence

[57] ABSTRACT

A marine anchor including a main fluke with a shank attached to the fluke. To enable the anchor to orientate on the sea bed from an inverted position to an upright working position, auxiliary flukes are supported by respective lugs upstanding from the fluke on either side of the anchor's vertical plane of symmetry. The auxiliary flukes extend laterally from the lugs and are inclined at an acute angle to the main fluke. The anchor includes support means arranged such that when the anchor lies inverted on a firm seabed one of the auxiliary flukes is located in position for digging in when the anchor is pulled forwardly.

23 Claims, 6 Drawing Sheets

ANCHOR

DESCRIPTION

The present invention relates to an anchor for mooring a floating object to a mooring bed.

A fixed fluke anchor having a cranked shank which is capable of orientating to an upright digging attitude automatically by rolling when dragged inverted over most mooring bed surfaces is known from UK Patents Nos. 1356259 and 1513453. However, in certain mooring beds of firm clay, the rolling action can be impeded by the flat sides of the shank bearing against the mooring bed surface when the anchor has rolled approximately 45 degrees onto its side.

It is an object of the present invention to obviate or mitigate this problem.

Marine anchors as described above have a fluke angle $\theta$ defined by the angle between a line extending from the anchor cable attachment point on the shank to the rear of the fluke and a fluke central line. The fluke central line is in fact constituted by the line intercept of a vertical symmetry plane of the anchor with the upper surface of the fluke, such a line intercept defining a forward direction. If the upper fluke surface is flat then the line intercept is a straight line: however if the fluke upper surface is longitudinally curved giving a curved intercept then the pertinent straight fluke intercept line would be the chord subtended by the "curved" intercept. In this specification, this chord is identified by the expression "fluke central line". Also, similar fluke longitudinal intercept lines could be obtained on the fluke by planes parallel to said vertical symmetry plane. The above defines the expression "central fluke line or longitudinal fluke line as hereinbefore defined" used in this specification. The fluke angle $\theta$ can be within the range 25 degrees to 55 degrees.

According to the present invention there is provided an anchor comprising a fluke member arranged transversely to a longitudinal plane of symmetry of the anchor, a shank adapted at one end for attachment to an anchor line and at the other end for attachment to said fluke member, said fluke member including an upstanding lug on each side of said plane of symmetry; auxiliary flukes each attached to a respective lug so as to be remote from the plane of symmetry, each auxiliary fluke extending substantially transversely to said plane of symmetry and providing a leading surface inclined upwardly at an acute forwardly opening angle $\beta$, to a plane at right angles to said plane of symmetry and containing the fluke central one or a fluke longitudinal line as hereinbefore defined; and support means about which the anchor may tilt when inverted on a firm horizontal mooring bed surface to bring a lug and/or an auxiliary fluke into contact with the mooring bed with said leading surface of the auxiliary fluke inclined upwardly at an obtuse forwardly opening angle $\beta_2$ to the horizontal mooring bed surface.

Preferably said tilt is sustained under gravity on a firm horizontal mooring bed surface.

Preferably at least a portion of the surface of said lug facing the shank has a forward opening angle $\gamma$ measured in the forward direction at right angles to the plane of symmetry in the range $-2$ degrees $+20$ degrees with 4 degrees to 12 degrees preferred, and preferably additionally has an upwards opening angle $\alpha$ relative to the plane of symmetry in the range 0 degrees to 40 degrees measured in a plane orthogonal to the forward direction with 8 degrees to 18 degrees preferred.

Preferably the lug surface area facing the shank on each side of said plane of symmetry is in the range of 2 to 12 per cent of the area of the fluke member viewed at right angles to the forward direction parallel to the plane of symmetry and preferably is in the range 3 to 7 per cent of said area of the fluke member.

Preferably the said forward opening angle $\alpha_1$ of the leading surface of the auxiliary fluke is in the range 20 degrees to 80 degrees with 55 degrees to 70 degrees preferred.

Preferably further the leading surface of said auxiliary fluke has a downwardly and forwardly opening angle $\Delta$ relative to the plane of symmetry, measured in a plane at right angles to both said leading surface and the plane of symmetry, in the range 60 degrees to 90 degrees with 65 degrees to 75 degrees preferred, and preferably the fluke leading surface area at each side of said plane of symmetry does not exceed 12 per cent of the area of the fluke member viewed at right angles to the forward direction parallel to the plane of symmetry and preferably is in the range 2 to 7 per cent of said area of the fluke member.

Preferably said auxiliary fluke is spaced above the fluke central line.

In a preferred embodiment the support means is located such that when the anchor is inverted and tilted onto said lug or auxiliary fluke on a firm planar horizontal surface, the centre of area of the fluke member is not less than 40 per cent of the fluke member width above said planar surface and preferably not less that 50 per cent of the fluke member width above said planar surface, and preferably the support means is located such that, when the anchor is inverted on a firm horizontal planar surface of a mooring bed and tilted thereon with said lug and said auxiliary fluke just buried in the bed, the portion of the fluke surface facing the mooring bed and adjacent the lug is inclined to the horizontal at not less than 45 degrees.

Preferably the support means comprises a plate member spaced from the fluke on the plane of symmetry and extending at right angles thereto, and preferably the support means is attached to the shank.

In an alternative arrangement the support means comprises one leg of a cranked shank. Preferably the fluke member has a bent up side portion to which said lug is attached, and preferably said side portion of the fluke member forms an angle in the range 45 degrees to 90 degrees to said plane of symmetry.

Embodiments of the present invention will now be described by way of example with reference to the accompanying drawings in which:

FIGS. 6 to 13 show various stages by the anchor of FIG. 1 orientating from an inverted position on a mooring bed surface to a buried position in the mooring bed, FIGS. 6 to 8 being front views while FIGS. 9 to 13 are isometric views;

Figure 1:
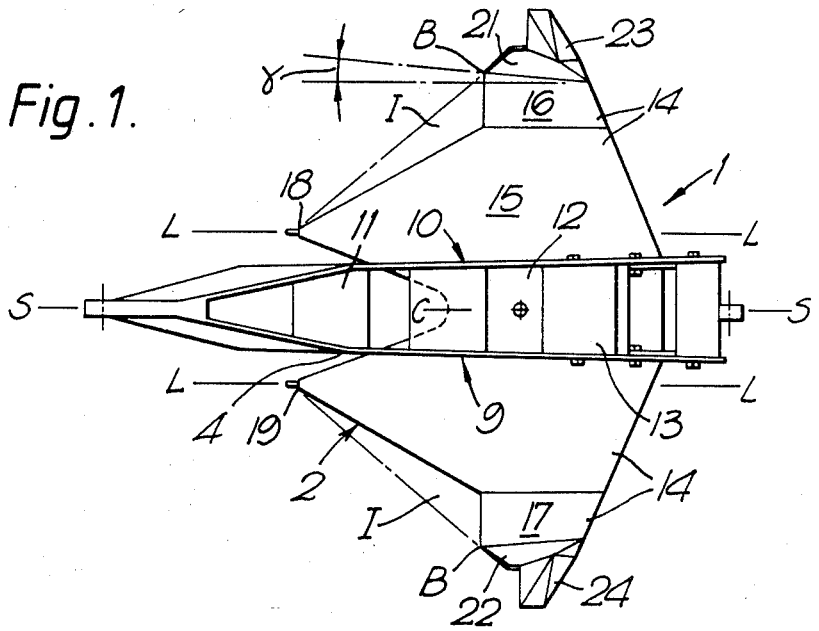
FIG. 1 shows a plan view of a marine anchor according to the present invention.

Referring to FIGS. 1 to 5, a marine anchor 1 for use in mooring a floating structure such as a floating oil rig, comprises a fluke member 2 and a cranked shank 3 which is in accordance with the Applicant's European Patent 0020152 and which includes a longer forwardly extending leg 4 carrying an attachment hole 5 for the anchor line (not shown) and a shorter leg 6 attached to the fluke member 2 by a bolted connection 7 at upstanding flanges 8 on the fluke member 2. The fluke member 2 extends transversely to a vertical plane of symmetry S—S of the anchor.

The shank 3 is of double-leg configuration formed by longitudinal plates 9,10 and differently inclined strengthening plates 11, 12, 13 extend transversely between the longitudinal plates 9, 10 and provide rearwardly directed diverging passages for unobstructed soil flow through the shank 3. The anchor has a fluke angle $\theta$ defined by the angle between a line B—B extending from the cable attachment hole 5 to the rear of the fluke member and the fluke central line C—C (as hereinbefore defined). Since in the present embodiment, the relevant central upper part of the fluke member 2 is flat this intercept will be a straight line. Also other longitudinal fluke intercept lines L—L obtained on the fluke member by vertical planes parallel to the symmetry plane S—S are shown in FIG. 1. In this embodiment the angle $\theta$ is approximately 28 degrees.

The fluke member 2 includes a fluke central part 14 of concave form, having a central sole 15 with upwardly bent side portions 16-17 and the sole 15 extends forwardly to two spaced toes 18, 19. The side portions 16, 17 form an angle $\delta$ with the symmetry plane S—S (or plane parallel thereto) preferably lying in the range 45 degrees to 90 degrees. The fluke central part 14 is fabricated from steel plate and includes reinforcing ribs 20 extending to the toes 18, 19. As can be seen, the upper surface of the sole 15 is flat. Additionally the fluke member 2 provides upstanding lugs 21, 22 carried by respective fluke portions 16, 17. Each lug 21, 22 has a forwardly opening angle $\delta$ measured in the forward direction relative to the plan of symmetry in the range $-2$ degrees to $+20$ degrees and preferably 4 degrees to 12 degrees, and an upwardly opening angle $\alpha$ relative to the plane of symmetry in the range 0 degrees to 40 degrees with 8 degrees to 18 degrees preferred. Also, the surface area of each lug 21, 22 facing the shank is in the range 2 per cent to 12 per cent of the area of the fluke member viewed at right angles to the forward direction parallel to the plane of symmetry, preferably this area is in the range 3 per cent to 7 per cent of said fluke member area.

Figure 2:
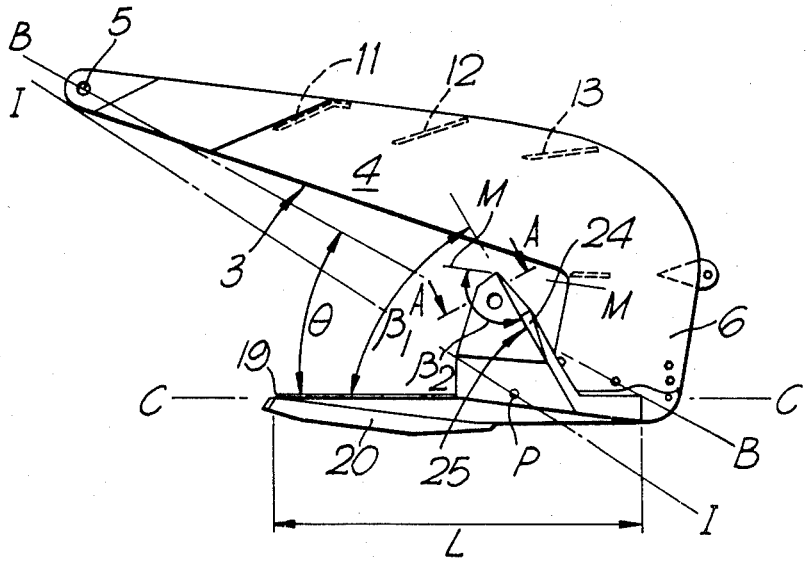
FIG. 2 shows a side elevation of the anchor of FIG. 1.
Figure 3:
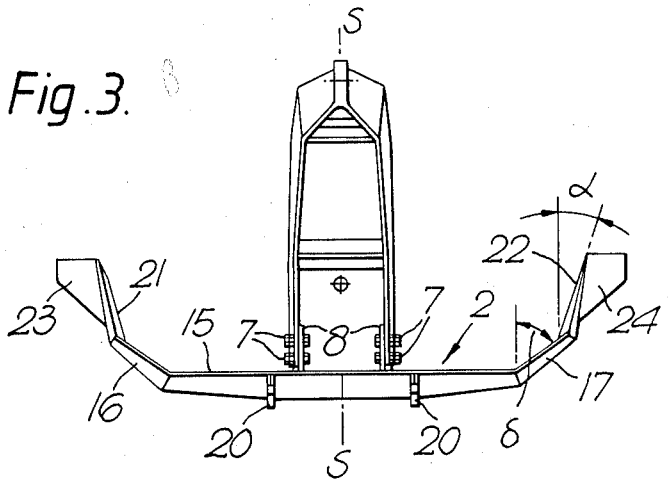
FIG. 3 shows a front view of the anchor of FIG. 1.
Figure 4:
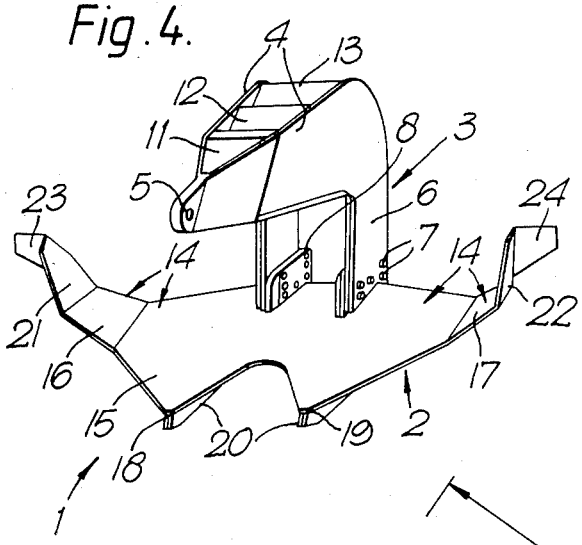
FIG. 4 shows an isometric view of the anchor.
Figure 5:
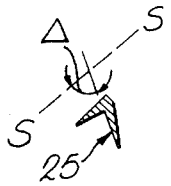
FIG. 5 shows the section A—A in FIG. 2.
Figure 6:
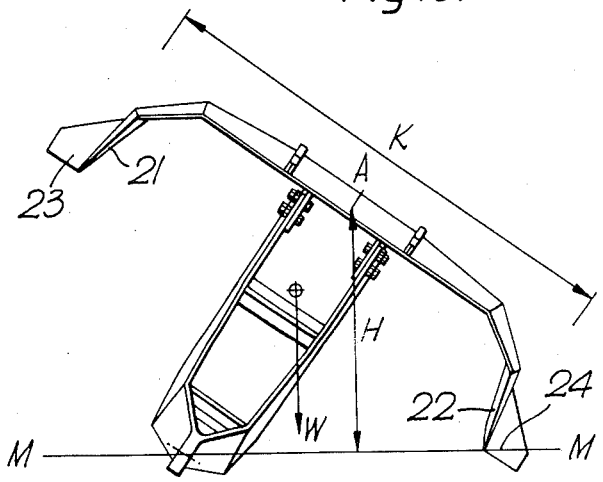

In accordance with the present invention, each lug 21, 22 has attached thereto a respective auxiliary fluke (or trigger element) 23, 24 each of which has a leading surface 25 which is inclined upwardly at an acute angle forwardly opening angle $\beta_1$ to the fluke central line C—C (or a fluke longitudinal line L—L). This acute angle $\beta_1$ can lie in the range 20 degrees to 80 degrees, and preferably {degrees to 70 degrees. Further the area of each surface 25 preferably lies in the range 1 per cent to 7 per cent of the area of the fluke member 2 viewed at right angles to the forward direction parallel to the plane of symmetry (this range will be particularly suitable for clay soils); however for soft mud mooring beds a range up to 12 per cent may be preferable. Further, when the anchor 1 lies in an inverted position as shown in FIG. 6 with an outer edge of the shank longer leg 4 serving to support the anchor on a firm mooring bed M (e.g. clay) but with the anchor tilted so that a lug 21 and an auxiliary fluke 23 engage the bed M, the leading surface 25 forms an obtuse angle $\beta_2$ with the mooring bed M as shown in FIG. 2. The upper ends of the plates 11, 12, 13 will also assist in supporting the inverted anchor and in particular will mitigate against sinking of the shank when lying inverted on relatively soft mooring beds. Additionally the leading surface 25 forms an angle $\Delta$ (see FIG. 5) relative to the plane of symmetry S—S measured in a plane at right angles to both said leading surface 25 and the symmetry plane S—S: this angle $\Delta$ can lie in the range 60 degrees to 90 degrees with 65 degrees to 75 degrees preferred.

As can be seen in FIG. 2, each auxiliary fluke 23, 24 lies above the level of the fluke sole portion 15 and more particularly above the level of the fluke central line C—C. More especially each auxiliary fluke is positioned such that it lies above the line I—I (FIG. 2) extending from the front end of the bottom edge of the shank longer leg 4 to the point P on the fluke central line C—C spaced 0.66 L from the front end of the fluke member 2, where L is the length of the fluke member, and indeed the flukes 23, 24 lie substantially above this line even when the line extends to the rear of the fluke. The effect of this is that when the anchor 1 is burying normally, the major portion of the fluke member 2 will be buried before the negatively acting auxiliary flukes 23, 24 engage the mooring bed, and this combined with the fact that the area of leading surfaces 25 is much smaller than the positive "burying" area of the fluke member facilitates deep burial of the anchor. The lugs 21, 22 and the flukes 23, 24 are also fabricated from steel plate.

A significant feature of the above described anchor is that the leading edges of the fluke 2 on each side of the plane of symmetry are of indented form, that is to say the leading edges are cut back at I in plan view with respect to a straight line drawn from a front point 19 (or 18) of the fluke to a point B at the outer edge of the fluke 2, i.e. at the joining edge of the plates 16, 17 and lugs 21, 22 as shown in FIG. 1. The provision of adequate such indentation of the fluke greatly assists the rolling action of the anchor to the vertical working burial attitude.

OPERATION

Figure 7:
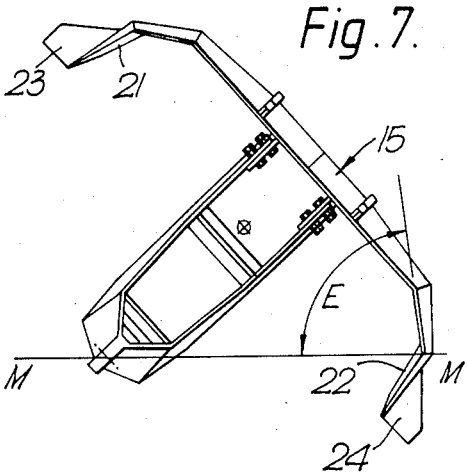
Figure 8:
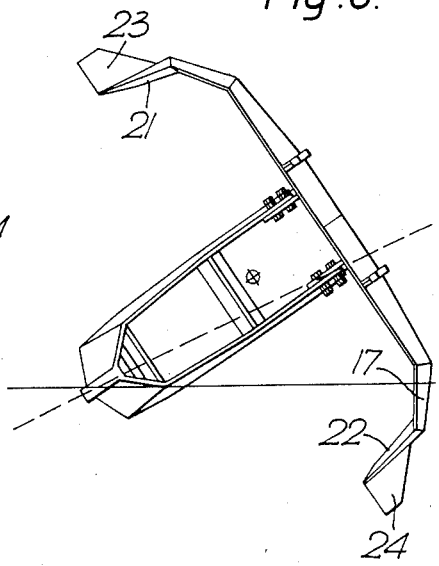
Figure 9:
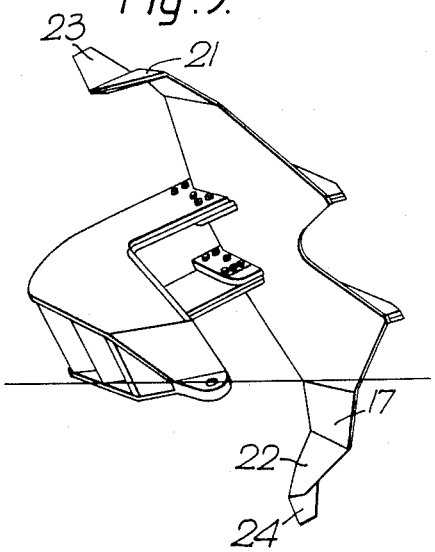
Figure 10:
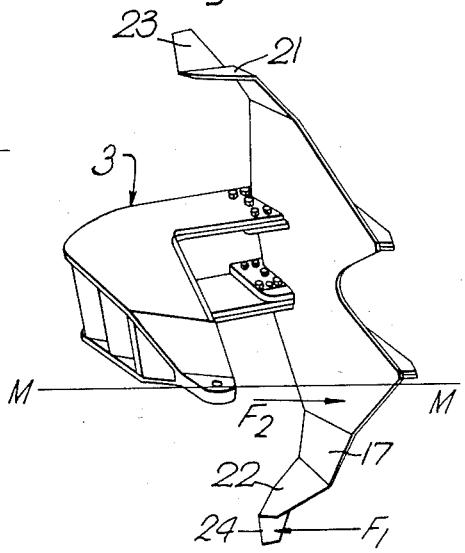
Figure 11:
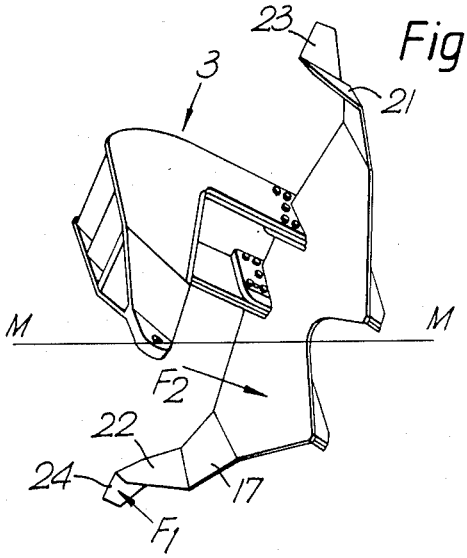
Figure 12:
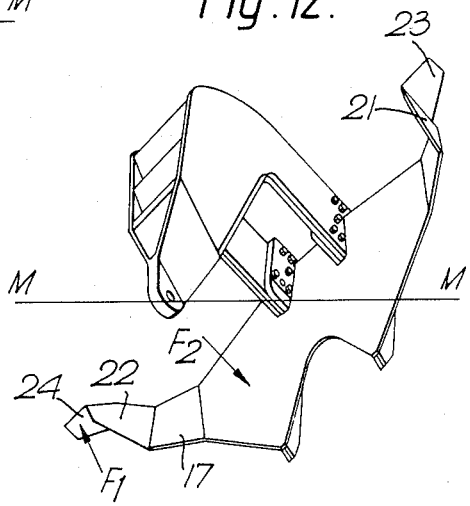
Figure 13:
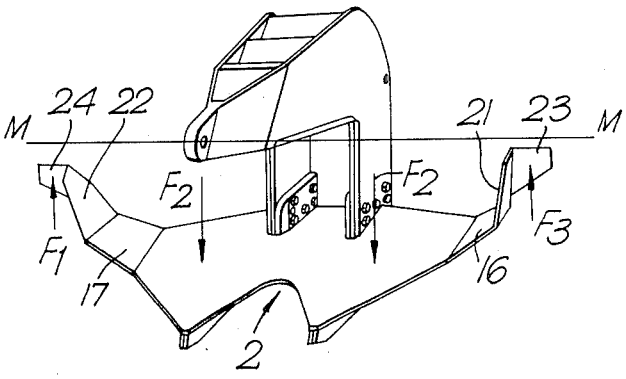

FIGS. 6 to 13 show anchor orientation in firm clay. The anchor 1 is unstable when dragged inverted and quickly topples about the longer leg 4 of the shank 3 until one lug (e.g. 22) and an auxiliary fluke 24 bears on the mooring bed surface M and is held there by the moment of the weight W of the anchor 1 acting about one edge of the longer leg 4 of the shank as shown in FIG. 6. Further dragging causes the lug 22 and auxiliary fluke 24 to penetrate the mooring bed surface M progressively as shown in FIGS. 7, 8 and 9 with the anchor rotating substantially about the top edge of the long leg 4 of the shank in contact with the mooring bed. When an appreciable portion of the fluke member 2 has been pulled into the soil by the lug 22 and auxiliary fluke 24 as the anchor is pulled over the mooring bed surface, forces $F_1$, $F_2$ are generated producing a turning moment, or couple, as shown in FIG. 10. This couple acts to lift the shank 3 off the surface of the mooring bed M as the anchor rolls further (FIG. 11) until, in FIG. 12 enough of the fluke 2 is buried to pull the shorter leg 6 of the shank 3 into the soil. In FIG. 13, the rolling force $F_1$ from the buried auxiliary fluke 24 is counteracted by an opposing force $F_3$ from the other auxiliary fluke 23 with the result that the anchor 1 adopts an upright burial attitude (FIG. 13). This roll mechanism prevents the mooring bed surface reaching the position shown dashed in FIG. 8 whereby a side face of the shank 3 bears against the surface of the mooring bed and impedes rolling. Finally, the anchor proceeds to bury deeper into the mooring bed soil in the attitude shown in FIG. 13 when pulled further by the anchor cable since the upwards forces from the auxiliary flukes are much less than the downwards force produced by the main fluke due to the fact that the "negative" burial area of the auxiliary flukes 23, 24 is very much less than the "positive" burial area of the fluke member 2.

It is preferred in FIG. 1 that the height H of the centre of area of the fluke member 2 above the mooring bed M is not less than 40 per cent of the width K of the fluke member 2, and preferably not less 50 per cent of K. Also as seen in FIG. 7, when the auxiliary fluke 24 and lug 22 are just buried it is preferable that the fluke portion 17 is inclined to the horizontal at an angle E not less than about 45 degrees. When the anchor is in the position shown in FIG. 8, it will be noted that the fluke side portion 17 is substantially vertical and in a minimum resistant position to penetration so encouraging rolling to the positions in FIGS. 9 and 10. These features encourage the above described rolling mechanism. Additionally the flukes 23, 24 will function in combination with the lugs 21, 22 and the upwardly bent fluke portions 16, 17 to produce dynamic stability in the anchor 1.

The flukes 23, 24 are shown at the rear of the outer surface of the lugs 21, 22 and this arrangement could provide benefits with regard to soil deflection. However the flukes 23, 24 could very well be located at other positions on the lugs, and it is felt that a substantial mid-position would be advantageous.

Figure 14:
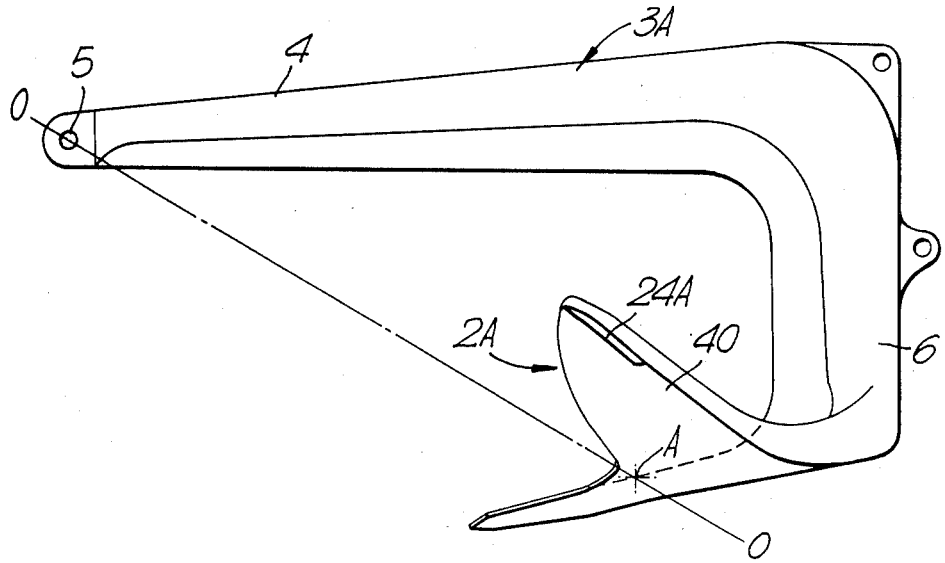
FIGS. 14 and 15 are a side view and a partial front view respectively of an anchor according to another embodiment.
Figure 15:
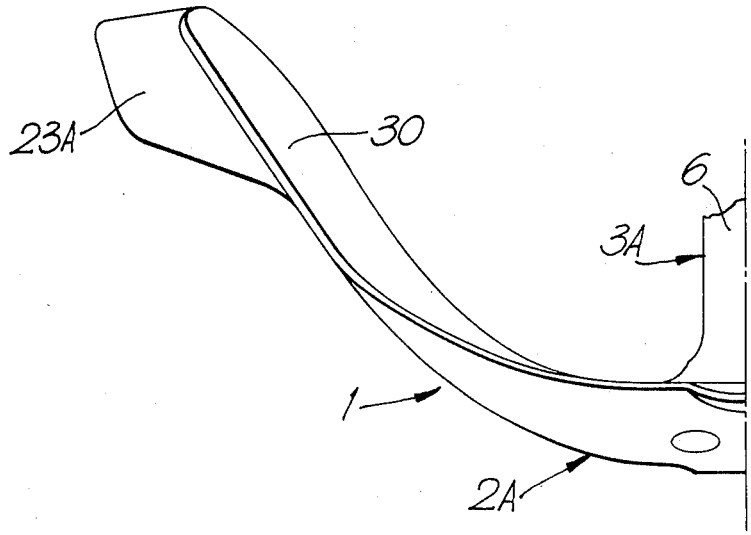

FIGS. 14 and 15 show the present invention applied in an anchor as described in UK Patents 1356259 and 1513453. Thus the anchor of FIGS. 14, 15 comprise a fluke 2A carried by single-leg cranked shank 3A with upward side lugs 30, 40 extending from the sides of the fluke 2A. The side lugs 30, 40 carry auxiliary flukes 23A, 24A generally corresponding to the lugs 23, 24 of the FIGS. 1 to 5 embodiment, and the flukes 23A, 24A will operate in a similar manner. UK Patent 1356259 teaches that the outer ends of the lugs 30, 40 can be outwardly twisted to form a greater convergence angle, but with the flukes 23A, 24A present this twisting can be removed or reduced.

Modifications are of course possible. Thus, some other means than the upper edges of the shank longer leg 4 could be employed to constitute the support means for the inverted anchor. Plate means could be used for this purpose, and if for example a shank of straight leg form is used these separate plate means could be attached to the straight shank. The fluke member 1 need not have a concave central part 15 but this part could be fully flat with the lugs 21, 22 attached directly to this flat construction. Again, the fluke member 2 may be constituted purely by upstanding lug parts with no central sole.

FIGS. 16 to 19 show two anchors which are generally similar to the anchor shown in FIGS. 1 to 5 and features in FIGS. 16 to 19 corresponding to the features of this previous anchor carry the same reference numerals or letters.

Figure 16:
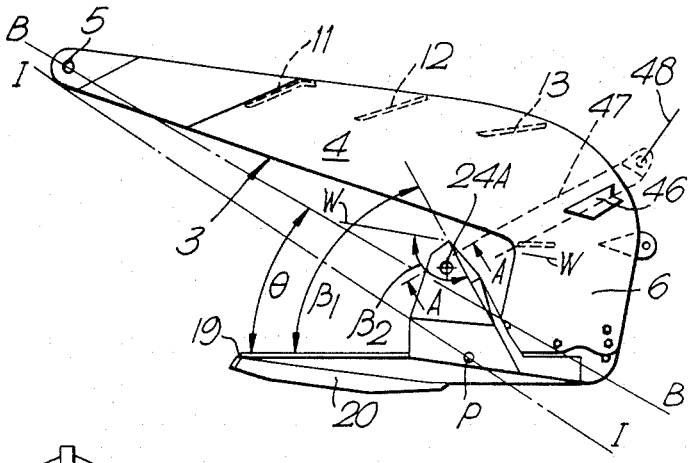
FIG. 16 shows a side elevation of an anchor according to another embodiment of the present invention.
Figure 17:
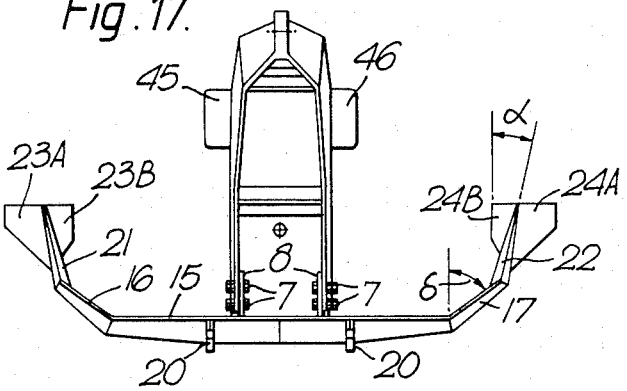
FIG. 17 shows a front view of the anchor of FIG. 16.
Figure 19:
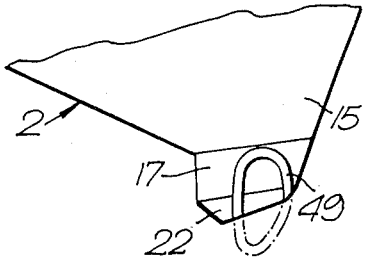
Figure 18:
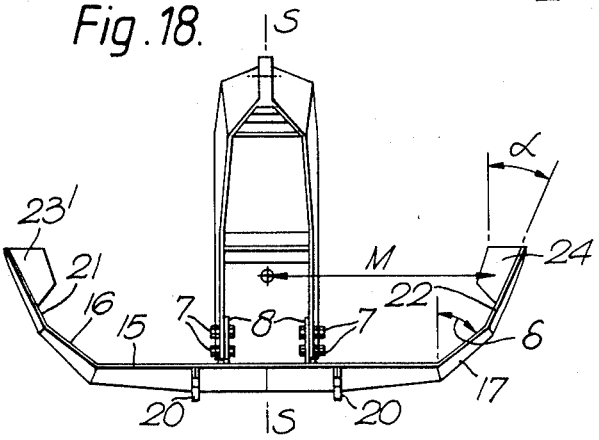
FIG. 18 shows a front view of an anchor according to yet a further embodiment of the present invention.

However, the anchor of FIGS. 16, 17 has auxiliary flukes (or trigger elements) each comprised by an outwardly extending portion 23A,(24A), equivalent to the flukes 23, 24 of the previous anchor, and additionally by an inwardly extending portion 23B, 24B; while the anchor of FIG. 18 has soley inwardly extending auxiliary flukes (or trigger elements) $23^1$, $24^1$.

In FIGS. 16, 17 the fluke portions 23A/B, 24A/B are again carried by upstanding side lugs 21, 22 on the anchor fluke 2, and these lugs 21, 22 can be set at an angle $\alpha$ from the vertical exactly as in the previous anchor of No. 8522062. Also, the fluke portions 23A/B, 24A/B are set at an acute angle $\beta_1$ to the fluke 2 within the range specified previously for $\beta_1$ the inner and outer portions are preferably set at the same acute angle $\beta_1$, but it would be possible to have these portions set at different acute angles relative to the fluke. The forwardly facing area of the outer portions 23A, 24A can have any suitable proportion relative to the equivalent area of the inner portions 23B, 24B, and in the example of FIGS. 16, 17 the outer portions have a greater forwardly facing area than the inner portions. With regard to the anchor of FIGS. 1 to 5 the outer portions 23A, 24A of the present anchor could have proportionally smaller area than the equivalent flukes 23, 24 of the previous anchor. A twin-leg shank 3 of cranked form is again used in accordance with European Patent No. 0020152.

The flukes 23A/B, 24A/B function as trigger elements when the anchor lies inverted on the sea bed and supported by an outer surface (edge) of the shank 3 and serve to orientate the anchor towards an upright working burial attitude. More specifically the orientating action is as described for the anchor of FIGS. 1 to 5. By providing the auxiliary flukes 23, 24 with outer and inner portions it should be possible to reduce the stress loading on the anchor structure during anchor operation.

Additionally the shank 3 carries laterally and rearwardly extending support ears 45, 46 for an anchor chaser or retrieval device 47 (shown dashed) which can be pulled down the anchor line (not shown) by means of a pennant line 48 and onto the shank 3 to the position shown. The chaser 47 is preferably constructed in accordance with UK Patent 1578129 (U.S. Pat. No. 4,098,216). The ears 45, 46 may also serve to assist anchor orientation particularly when the anchor line (not shown) connected at hole 5 is incident at a fairly substantial angle from the horizontal and away from the sea bed.

In the embodiment shown in FIG. 18, the auxiliary flukes $23^1$, $24^1$ extend wholly inwardly from the side lugs 21, 22 towards the anchors plane of symmetry S—S. In this case the lugs 21, 22 are preferably set at a greater acute angle $\alpha$ to the vertical than previously and this will tend to ensure that the moment arm M from the centre of area of the auxiliary fluke to the anchors plane of symmetry S—S will be substantially the same as in the previous embodiment. The angle $B_1$ will be similar as in previous embodiments. It is felt that the absence of outwardly extending auxiliary fluke portions could convenience the handling of the anchor in some stuations.

The flukes $23^1$, $24^1$ will again serve as trigger elements in the manner set out for the previous embodiment to orientate the anchor to an upright working burial attitude.

I claim:

1. A marine anchor comprising a fluke arranged transversely to a longitudinal plane of symmetry of the anchor, a shank adapted at one end for attachment to an anchor line and at the other end for attachment to said fluke, said fluke including a main fluke member and fluke side structures on each side of said plane of symmetry, each fluke side structure including an upstanding lug and an auxiliary fluke attached to the lug so as to be remote from the plane of symmetry, each auxiliary fluke extending substantially transversely to said plane of symmetry and providing a leading surface inclined upwardly at an acute forwardly opening angle $\beta_1$ to a plane at right angles to said plane of symmetry and having a fluke central line; and support means about which the anchor tilts when inverted on a firm horizontal mooring be surface to bring one of said fluke side structures into contact with the mooring bed with the leading surface of the auxiliary fluke of said one fluke side structure inclined upwardly at an obtuse forwardly opening angle $\beta_2$ to the horizontal mooring bed surface whereby the auxiliary fluke digs into the mooring bed surface on forward movement of the inverted anchor.

2. An anchor as claimed in claim 1, wherein said tilt is sustained under gravity on a firm horizontal mooring bed surface.

3. An anchor as claimed in claim 1 wherein at least a portion of the surface of each upstanding lug of the fluke side structure has a forward opening angle $\gamma$ measured in the forward directions at right angles to the plane of symmetry in the range $-2$ degrees to $+2$ degrees.

4. An anchor as claimed in claim 3, wherein said forward opening angle $\gamma$ lies in the range 4 degrees to 12 degrees.

5. An anchor as claimed in claim 1 wherein at least a portion of each upstanding lug has an upwards opening angle $\alpha$ relative to said plane of symmetry in the range of 0 degrees to 40 degrees measured in a plane orthogonal to the forward direction.

6. An anchor as claimed in claim 5, wherein said angle $\alpha$ lies in the range 8 degrees to 18 degrees.

7. An anchor as claimed in claim 1, wherein the lug surface area facing the shank on each side of said plane of symmetry is in the range of 2% to 12% of the area of the main fluke member viewed at right angles to the forward direction parallel to the plane of symmetry.

8. An anchor as claimed in claim 1, wherein said forward opening angle $\beta_1$ of the leading surface of the auxiliary fluke is in the range 20 degrees to 80 degrees.

9. An anchor as claimed in claim 8, wherein said angle $\beta_1$ is in the range 55 degrees to 70 degrees.

10. An anchor as claimed in claim 1 wherein the leading surface of each auxiliary fluke has a downwardly and forwardly opening angle $\Delta$ relative to the plane of symmetry, measured in a plane at right angles to both said leading surface and the plane of symmetry, in the range 60 degrees to 90 degrees.

11. An anchor as claimed in claim 1, wherein the area of the leading surface of each auxiliary fluke does not exceed 12% of the area of the main fluke member viewed at right angles to the forward direction parallel to the plane of symmetry.

12. An anchor as claimed in claim 11, wherein said leading surface area of each auxiliary fluke lies in the range 1% to 7% of the area of the main fluke member.

13. An anchor as claimed in claim 1, characterized in that each auxiliary fluke is spaced above the fluke central line.

14. An anchor as claimed in claim 1, wherein the support means are located such that when the anchor is inverted and tilted onto said fluke side structure on a firm planar horizontal surface, the center of area of the main fluke member is not less than 40% of the main fluke member width above said planar surface.

15. An anchor as claimed in claim 1, wherein the support means is located such that, when the anchor is inverted on a firm horizontal planar surface of a mooring bed and tilted thereon with a lug and respective auxiliary fluke just buried in the bed, the portion of the fluke surface facing the mooring bed and adjacent the lug is included in the horizontal at not less than 45 degrees.

16. An anchor as claimed in claim 1, including an upstanding support member providing said support means such that said support means is spaced from the fluke.

17. An anchor as claimed in claim 1, wherein the support member is attached to the shank.

18. An anchor as claimed in claim 1, wherein the support means comprises one leg of a cranked shank.

19. An anchor as claimed in claim 1, wherein the main fluke member has a bent up side portion to which a lug of a fluke side structure is attached.

20. An anchor as claimed in claim 19, wherein said bent up side portion of the main fluke member forms an angle in the range 45 degrees to 90 degrees with said plane of symmetry.

21. An anchor as claimed in claim 1 wherein the auxiliary fluke has at least a portion extending outwardly from the respective lug.

22. An anchor as claimed in claim 1, the auxiliary fluke has at least a portion extending inwardly from the respective lug.

23. An anchor as claimed in claim 1 wherein the leading edges of the main fluke member on each side of the plane of symmetry are of indented form as viewed in plan.

* * * * *